US005092138A

United States Patent [19]

Radermacher et al.

[11] Patent Number: 5,092,138

[45] Date of Patent: Mar. 3, 1992

[54] REFRIGERATION SYSTEM

[75] Inventors: Reinhard Radermacher, Silver Spring; Dongsoo Jung, Ellicott City, both of Md.

[73] Assignee: The University of Maryland, College Park, Md.

[21] Appl. No.: 550,492

[22] Filed: Jul. 10, 1990

[51] Int. Cl.[5] ..... F25B 1/00

[52] U.S. Cl. ..... 62/502; 62/114

[58] Field of Search ..... 62/502, 149, 114, 122; 252/67

[56] References Cited

U.S. PATENT DOCUMENTS 4,416,119 11/1983 Wilson et al. ..... 62/502

5,012,651 5/1991 Nakatani et al. ..... 62/502

*Primary Examiner*—Albert J. Makay

*Assistant Examiner*—John Sollecito

*Attorney, Agent, or Firm*—Oblon, Spivak, McClelland, Maier & Neustadt

[57] ABSTRACT

A dual evaporator refrigeration system cooling separate compartments at different temperatures employ specific combinations of refrigerants as working fluids. Each of the working fluids is a binary combination which yields enhanced efficiency in the dual evaporator system.

4 Claims, 1 Drawing Sheet

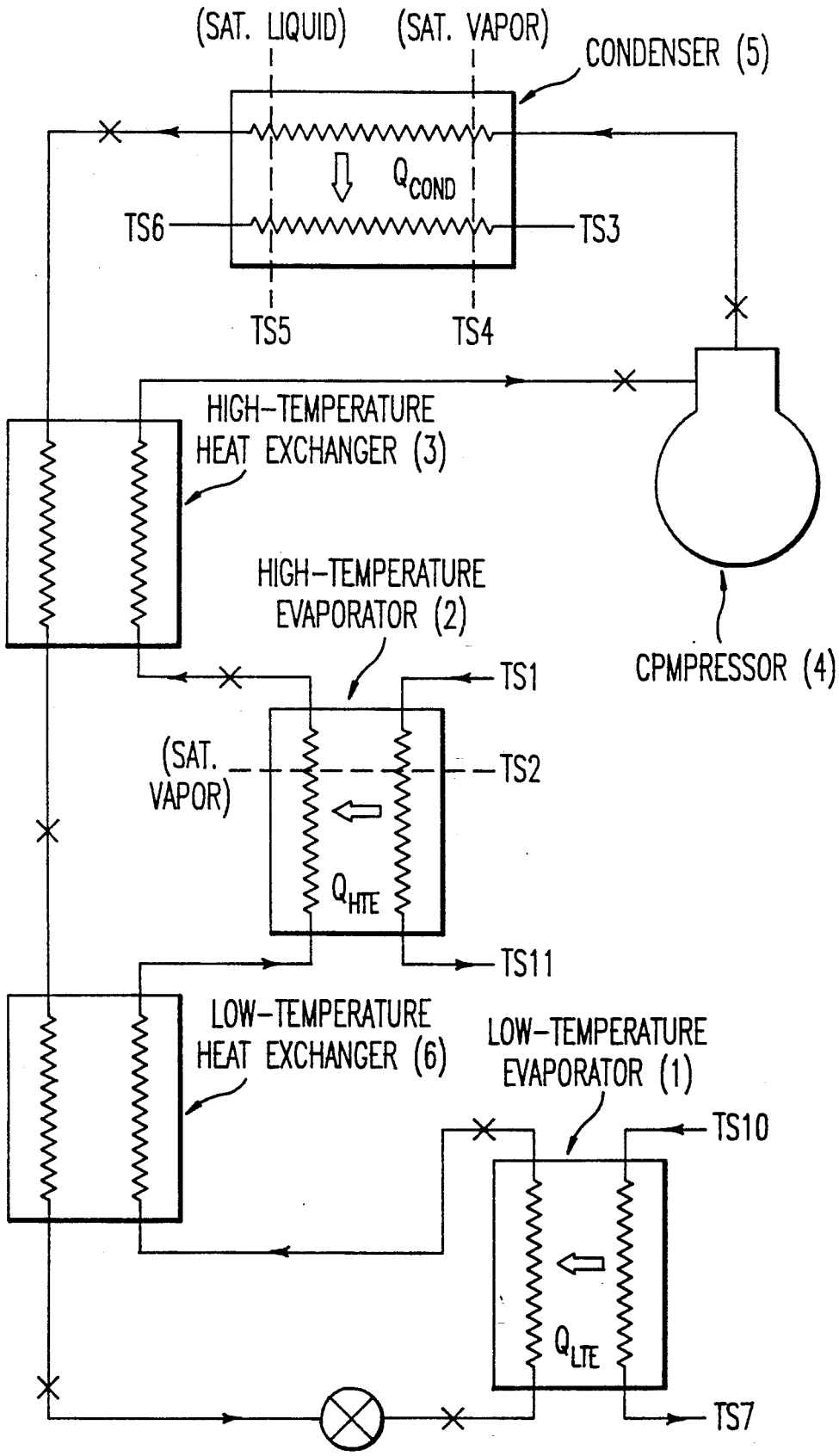
(SAT. LIQUID)
(SAT. VAPOR)
CONDENSER (5)
$Q_{COND}$
TS6
TS3
TS5
TS4
HIGH-TEMPERATURE HEAT EXCHANGER (3)
HIGH-TEMPERATURE EVAPORATOR (2)
CPMPRESSOR (4)
TS1
(SAT. VAPOR)
TS2
$Q_{HTE}$
TS11
LOW-TEMPERATURE HEAT EXCHANGER (6)
LOW-TEMPERATURE EVAPORATOR (1)
TS10
$Q_{LTE}$
TS7

REFRIGERATION SYSTEM

BACKGROUND OF THE INVENTION

1. Field of the Invention

The present invention relates to a two-evaporator refrigeration system employing novel, highly efficient working fluid mixtures, designed to cool two separate compartments at different temperatures in the same device (e.g., as in a refrigerator/freezer unit). The novel working fluid mixtures of the present invention are specifically designed for a two-evaporator refrigeration system.

2. Prior Art

It is well known in the art that mixtures of fluids can be more efficient in a refrigeration cycle than a single refrigerant employed alone.

A dual evaporator system employing a binary refrigerant is disclosed by Wilson et al (U.S. Pat. No. 4,416,119) for use in a refrigerator/freezer. The circuit employs alternating evaporators and heat exchangers, thus requiring exactly two heat exchangers. Other elements, e.g., a separator and a rectifier, are further required in the system disclosed by Wilson et al. Also disclosed is a mixture of R22 (monochlorodifluoromethane) and R114 (1,2-dichloro-1,1,2,2-tetrafluoroethane) as the refrigerant, but a non-azeotropic mixture of R12 (dichlorodifluoromethane) and R11 (trichloromonofluoromethane) is particularly preferred.

One condition under which a working fluid mixture can be more efficient than any of the single components thereof is identified by Vobach (U.S. Pat. Nos. 4,707,996 and 4,674,297), wherein a mixture of a low-boiling refrigerant, such as R22 or R32 (difluoromethane), and a high-boiling solvent, such as 1,1,1-trichloroethane, exhibits a negative deviation from Raoult's Law.

Another condition where a mixture of refrigerants can be more efficient is disclosed by Rojey (U.S. Pat. Nos. 4,350,020 and 4,344,292), wherein a difference of greater than or equal to 20° C. in the critical temperature exists between the two components of the mixture. The preferred mixture in this case was R22 and R114.

SUMMARY OF THE INVENTION

One object of the present invention is to provide a two-evaporator refrigeration system comprising a high-temperature and a low-temperature evaporator within a single cycle as a means to efficiently maintain two separate compartments of the same device at two different temperatures.

Novel refrigerant mixtures are provided as working fluid mixtures for this two-evaporator refrigeration cycle. The refrigerant mixtures of the present invention have been found to be particularly useful in this cycle.

A further object of the present invention is to provide a two-evaporator refrigeration system further comprising high-temperature and low-temperature heat exchangers.

Other aspects and advantages of the refrigeration system and the novel refrigerant mixtures of the present invention are disclosed in the following descriptions of the drawing and the preferred embodiments.

BRIEF DESCRIPTION OF THE DRAWING

FIG. 1 is a schematic illustration of the inventive refrigeration system.

DETAILED DESCRIPTION OF THE DRAWING

Low-temperature evaporator 1 is connected by a conduit to high-temperature evaporator 2. From high-temperature evaporator 2, the components of the refrigerant mixture (which may or may not have the same ratio as in low-temperature evaporator 1) flows through a conduit through high-temperature heat exchanger 3, then continues through a conduit to compressor 4. After compression, a conduit carries the components of the fluid mixture through condenser 5, where it is converted from the vapor phase to the liquid phase. The working fluid mixture flows through another conduit to high-temperature heat exchanger 3, continuing back to low-temperature evaporator 1.

An optional low-temperature heat exchanger 6 can be placed in the system, such that the conduit connecting low-temperature evaporator 1 to high-temperature evaporator 2 and the conduit connecting high-temperature heat exchanger 5 to low-temperature evaporator 1 passes through by the low-temperature heat exchanger 6.

DESCRIPTION OF THE PREFERRED EMBODIMENTS

The two-evaporator refrigeration circuit, as shown schematically in FIG. 1, is intended for use in applications wherein two separate compartments of the same device are required to be kept at different temperatures. Preferably, the circuit of the present invention is used in a refrigerator/freezer unit, wherein one compartment must be maintained at a temperature slightly above the freezing point of water, and a second compartment maintained at a temperature substantially below the freezing point of water.

In addition to the required elements (a low-temperature evaporator, a high-temperature evaporator, a compressor, a condenser, and a high-temperature heat exchanger, all in a closed circuit, employing one of the inventive refrigerant mixtures as the working fluid therein), a low-temperature heat exchanger may be optionally employed as shown in FIG. 1.

The novel refrigerant mixtures to be employed as the working fluid in the refrigeration cycle of the invention have been carefully selected to maximize performance in the dual evaporator apparatus of the system. The five preferred refrigerant mixtures of the present invention were chosen on the basis of their calculated coefficient of performance (COP), shown in Table 1, along with other pertinent data.

The five preferred refrigerant mixtures are:

(1) monochlorodifluoromethane (R22) and 1,1-dichloro-2,2,2-trifluoroethane (R123), (2) R22 and 1,1-difluoro-1-chloroethane (R142b), (3) difluoromethane (R32) and 1,1-difluoro-1-chloroethane (R142b), (4) R32 and 1-chloro-1,2,2,2-tetrafluoroethane (R124), and (5) R124 and 1,1-difluoroethane (R152a).

(6) R22 and 1,1-dichloro-1-fluoroethane (R141b).

Exemplary volumes for each combination vary. Specific examples optimizing performance for particular combinations include:

| Combination | | Weight Ratio |
|---|---|---|
| 1 | R22/R123 | 80/20 |
| 2 | R22/R142b | 50/50 |

-continued

| Combination | | Weight Ratio |
|---|---|---|
| 3 | R32/R142b | 50/50 |
| 4 | R32/R124 | 40/60 |
| 5 | R124/R152a | 60/40 |
| 6 | R22/R141b | 70/30 |

The two components of the working fluid may be present in widely ranging amounts. On a weight basis, it is preferred that the working fluid be present in ratios of 9:1-1:9. A particularly preferred range is 8:2-2:8 with narrower ranges of 6:4-4:6 preferred for certain combinations.

TABLE

| Mixture | $COP_{max}$ | $\phi_{max}$ | $VC_{max}$ | $X_{max}$ | $COP_{VC}$ | $\phi_{VC}$ | $X_{VC}$ |
|---|---|---|---|---|---|---|---|
| R22/R152a | 1.426 | 6.0 | 1007 | 0.6 | 1.407 | 4.61 | 0.1 |
| R22/R124 | 1.443 | 7.29 | 934 | 0.5 | 1.432 | 6.47 | 0.3 |
| R125/ R152a | 1.415 | 5.20 | 902 | 0.3 | 1.41 | 4.83 | 0.1 |
| R125/ R142b | 1.455 | 8.18 | 652 | 0.3 | 1.45 | 7.8 | 0.4 |
| R125/R124 | 1.402 | 4.24 | 742 | 0.3 | 1.4 | 4.1 | 0.33 |
| R143a/ R142b | 1.46 | 8.55 | 700 | 0.3 | 1.457 | 8.32 | 0.35 |
| R143a/ R124 | 1.412 | 4.98 | 800 | 0.3 | 1.41 | 4.83 | 0.26 |
| R143a/ R123 | 1.428 | 6.17 | 1156 | 0.8 | 1.4 | 4.08 | 0.65 |
| R22/R141b | 1.517 | 12.28 | 906 | 0.7 | 1.495 | 11.12 | 0.65 |
| R22/R142b | 1.474 | 9.6 | 822 | 0.5 | 1.473 | 9.51 | 0.45 |
| R22/R123 | 1.527 | 13.53 | 1039 | 0.8 | 1.5 | 11.52 | 0.65 |
| R32/R142b | 1.512 | 12.41 | 1349 | 0.5 | 1.49 | 10.78 | 0.17 |
| R32/R124 | 1.482 | 10.18 | 1459 | 0.4 | 1.445 | 7.43 | 0.1 |
| R152a/ R123 | 1.494 | 11.07 | 487 | 0.6 | 1.402 | 4.34 | 1.0 |

Note: percent increase in COP, $\phi$, is based on the COP of R12 obtained with a conventional single evaporator refrigerator ($COP_{R125}$ = 1.345, $VC_{R12}$ = 769 kJ/m$^3$). $X_{max}$ in Tables 1 and 2 is the overall composition at which the maximum COP occurs while $X_{VC}$ is the overall composition at which the volumetric capacity of the mixture is the same as that of R12 with a single evaporator.

Obviously, numerous modifications and variations of the present invention are possible in light of the above teachings. For example, conventional additives or unavoidable pollutants may ultimately form part of the working fluid mixture, or means for monitoring and maintaining a desired temperature level in each of the two compartments may ultimately form part of the refrigeration system. It is therefore to be understood that within the scope of the appended claims, the invention may be practiced otherwise than as specifically described herein.

What is claimed as new and desired to be secured by Letters Patent of the United States is:

1. In a refrigeration system comprising two evaporators, a heat exchanger, a compressor and a condenser all in fluid communication through which a working fluid is circulated, the improvement wherein said working fluid consists essentially of a mixture selected from the group consisting of:

(1) monochlorodifluoromethane and 1,1-dichloro-2,2,2-trifluoroethane, (2) monochlorodifluoromethane and 1,1-difluoro-1-chloroethane, (3) difluoromethane and 1,1-difluoro-1-chloroethane, (4) difluoromethane and 1-chloro-1,2,2,2-tetrafluoroethane, (5) 1-chloro-1,2,2,2-tetrafluoroethane and difluoroethane, or (6) monochlorodifluoromethane and 1,1-dichloro-1-fluoroethane.

2. System of claim 1, wherein said system further comprises a second heat exchanger.

3. System of claim 1, wherein the two components of each of working mixtures (1)–(5) are present in a ratio, by weight, of 9:1-1:9.

4. System of claim 3, wherein said ratio is from 4:6-6:4.

* * * * *